US005428872A

United States Patent [19]

Papazian et al.

[11] Patent Number: 5,428,872

[45] Date of Patent: Jul. 4, 1995

[54] BUTTON RAPIDLY FITTED BY MEANS OF A STUD OR THREAD WITH THE POSSIBILITY OF RECOVERING IT AFTER FITTING

[76] Inventors: Zareh Papazian, 11 bis, avenue Henrey-Bordeaux, F-74000 Annecy; Richard Papazian, 7, allée des Iris, F-74420 Gaillard, both of France

[21] Appl. No.: 129,141

[22] PCT Filed: Apr. 6, 1992

[86] PCT No.: PCT/FR92/00306

§ 371 Date: Dec. 6, 1993

§ 102(e) Date: Dec. 6, 1993

[87] PCT Pub. No.: WO92/17082

PCT Pub. Date: Oct. 15, 1992

[30] Foreign Application Priority Data

Apr. 5, 1991 [FR] France ..... 91 04273

[51] Int. Cl.[6] ..... A44B 1/00

[52] U.S. Cl. ..... 24/90.1; 24/103; 24/108

[58] Field of Search ..... 24/90 R, 103, 108, 113 MP

[56] References Cited

U.S. PATENT DOCUMENTS

| | | | |
|---|---|---|---|
| 553,938 | 2/1896 | Reichelt | 24/90 R |
| 1,065,082 | 6/1913 | Saunders | 24/103 |
| 1,715,258 | 5/1929 | Tonn | 24/103 |
| 1,981,813 | 11/1934 | Schuster | 24/108 |
| 2,538,396 | 1/1951 | Sutin | 24/108 |
| 2,863,197 | 12/1958 | Statham | 24/90 R |
| 3,725,980 | 4/1973 | Burgio | 24/90 R |
| 4,723,421 | 2/1988 | Nitsche | 24/108 |
| 4,928,362 | 5/1990 | Collas et al. | 24/90 R |

FOREIGN PATENT DOCUMENTS

| | | | |
|---|---|---|---|
| 1159495 | 6/1958 | France | 24/103 |
| 2633811 | 1/1990 | France . | |

*Primary Examiner*—Victor N. Sakran

*Attorney, Agent, or Firm*—Synnestvedt & Lechner

[57] ABSTRACT

A novel system of rapidly securing a button using stud or thread is described, with the possibility of recovering the button after fitting. Improved appearance is achieved by rendering the stud penetration hole invisible on its upper surface. The button comprises an upper part or cup which can be fitted if necessary with a decorative cover (4). It also comprises a support or base with a transverse through hole (6) used for recovering the button or securing it in a conventional manner, the stud penetration hole having two retaining lugs, and also a serrated (2) or coarse (8) stud for securing the button to the fabric (7). The aim of the invention is to improve the appearance of existing "quick fit" buttons, to enable said buttons to be recovered, and to allow them to be secured in a conventional manner.

16 Claims, 2 Drawing Sheets

BUTTON RAPIDLY FITTED BY MEANS OF A STUD OR THREAD WITH THE POSSIBILITY OF RECOVERING IT AFTER FITTING

This invention concerns securing buttons using stud or thread, with the possibility of recovering the button after fitting.

The originality of this button consists in the design of the system by which the button is secured, in its varied applications (fast and traditional), in its recovery and in its aesthetic advantages.

We are aware of rapidly-fitted buttons using stud through the fabric, but they have the following disadvantages:

Stud and penetration hole visible and unaesthetic.

Buttons difficult or impossible to recover.

Impossible to sew buttons in the tradition manner.

Difficult to handle.

Need to hide the penetration hole with a cup.

This invention proposes to remedy all these disadvantages in a simple, precise and effective manner.

The introduction during manufacturing, at the injection stage, of a spit through the base of the button reducing the material at the hole level and creating two lugs, whose resilience during the penetration of the stud makes it possible to block-up and retain the button.

The stud is formed by a cone-shaped partwhose purpose is only to pierce the fabric, and by a cylindrical portion whose surface presents a serrated or coarse aspect, which will secure the button and the stud head.

The advantages of this system are:

The smaller and adapted size of the stud, makes it possible to avoid having it appear after securing, which will improve the appearance of existing "quick fit" buttons.

The button can be sewn in a conventional manner by using the holes left by the spit.

The button can later be recovered without damage by introducing a point or sharp-pointed object into the lateral holes in order to push the stud.

The head of the stud can be used as a counter-button when necessary (leather material, furs, . . . )

Easier handling by using studs adapted to the thickness of the support.

FIG. 1 shows a stud made of plastic comprising a cone-shaped part (2) used to pierce the fabric and also to secure the button. The head ended with a spherical pointed portion (1) and is used to penetrate through the fibers of the fabric.

Part (3) represents the head of the stud securing the button to the material.

Figure 2:
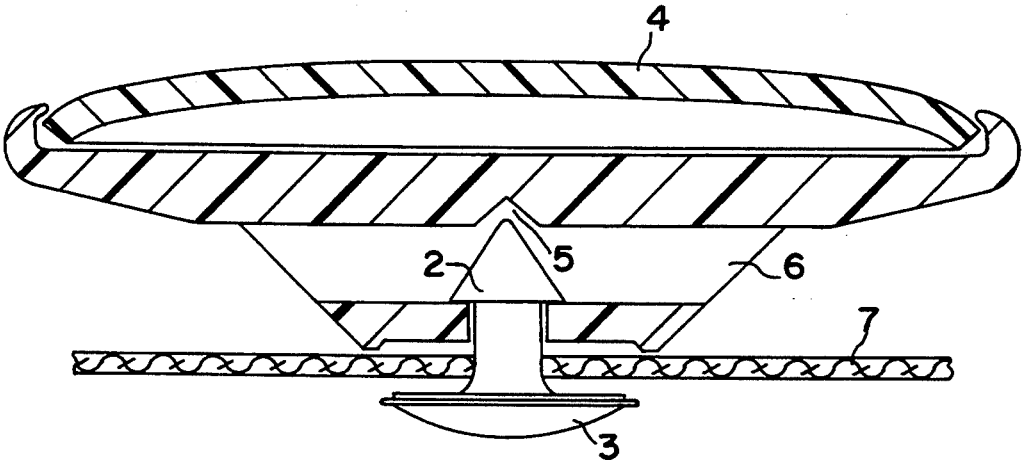
FIG. 2 shows a variant of the entire button-stud with a nested cap.

FIG. 2 represents a button fixed at its base by a serrated stud (2) to the material (7), and presenting, after introduction of the spit during manufacturing, a transverse hole (6) used for recovering this button by introducing a point or sharp-pointed object into the lateral holes in order to push the stud, and/or to sew with thread by using the holes left by the spit. This variant can accept a nested decorative cap (4).

Figure 3:
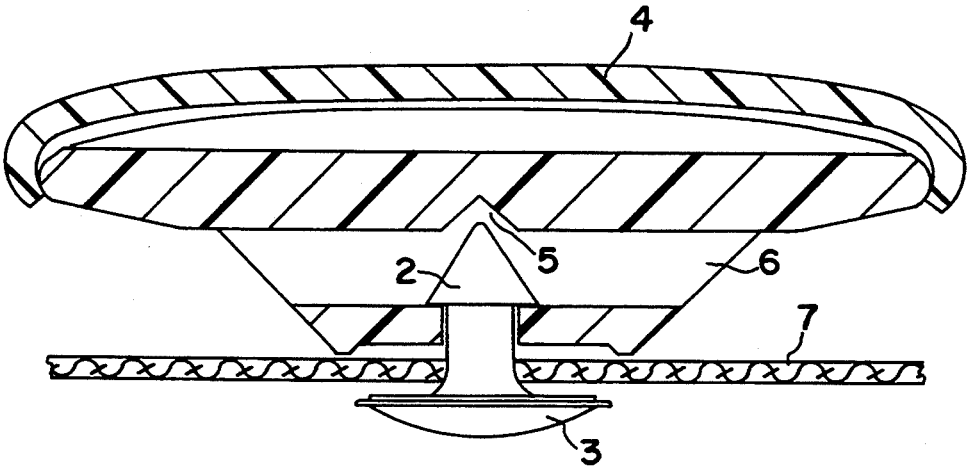
FIG. 3 shows a variant of the entire button-stud with cover cap.

In FIG. 3, the button represented in this variant is fixed the same way that in FIG. 2 and can accept to be recovered by a decorative cap (4).

Figure 1:
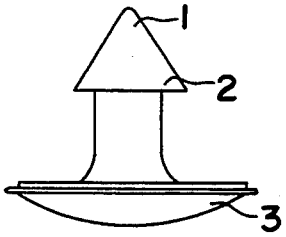
FIG. 1 shows a stud with locking catch.
Figure 4:
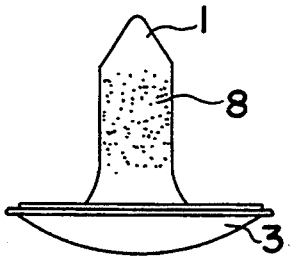
FIG. 4 shows a stud with a coarse stem.
Figure 5:
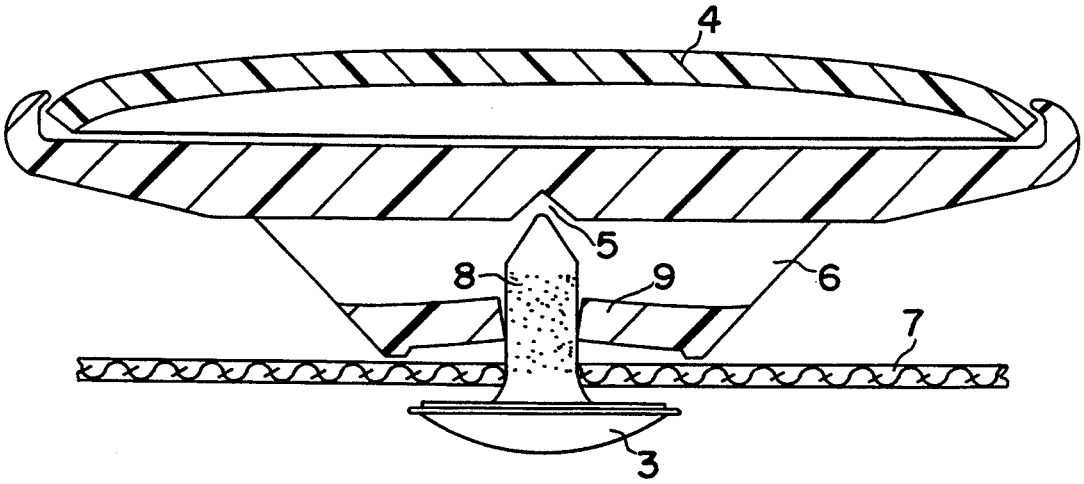
FIG. 5 shows a variant of the entire button-coarse stem stud with a nested cap.

In FIG. 4, a stud made in plastic comprising a coarse cone-shaped part (8) ended by a cone whose purpose is to pierce the fabric. As in FIG. 1, the point ended with a spherical pointed portion (1) used to penetrate through the fabric, and of the head of the stud (3) used to secure the button to the material. FIG. 5 shows a button fixed to its base by a serrated or coarse (8) stud making it possible to block-up against the lugs (9). These lugs are the result of reducing material made by the spit during manufacturing. A place (5) is planned for the point of the stud. As in the variants of figures 2 and 3, the button is transverse by a hole making possible to recover the button and/or to sew with thread in a conventional manner. This variant can accept a decorative nested cap.

Figure 6:
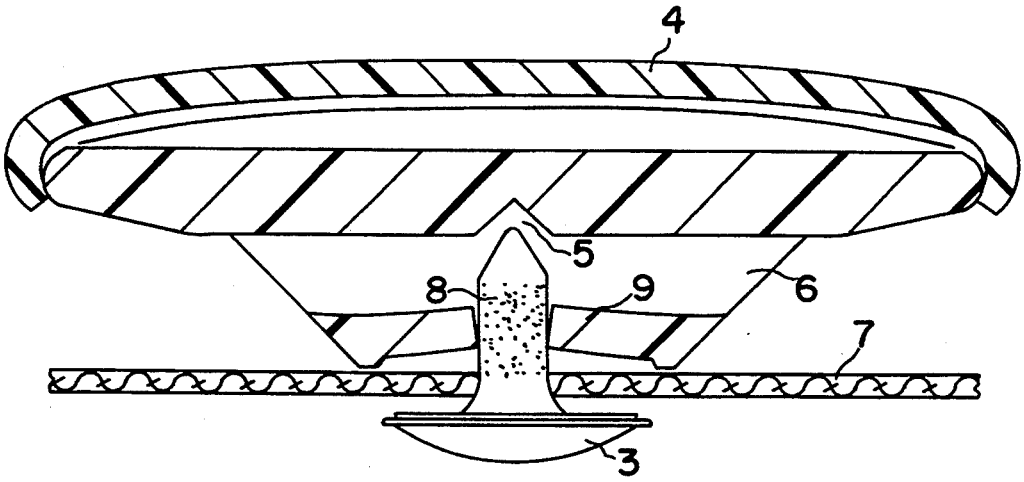
FIG. 6 shows a variant of the entire button-coarse stem stud with a cover cap.

In FIG. 6, the button represented is fixed the same way that the one in FIG. 5 and can be covered with a decorative cap (4).

We claim:

1. A reusable button assembly, comprising:

a) a stud having a head and a stem extending away from the head, the stem terminating in a securing means wherein the securing means is adapted to pierce a fabric and the head is adapted to prevent the stud from sliding completely through the fabric; and b) a base having a retaining means adapted to receive and releasably engage the securing means of the stud, the base also having a hole proximate, and transverse to, the retaining means adapted to allow a tool to have access to the securing means and the stem for facilitating the disengagement of the securing means from the retaining means.

2. The button assembly of claim 1, wherein the securing means comprises a substantially conical portion having a generally spherical pointed tip used to penetrate the fabric.

3. The button assembly of claim 2, wherein the retaining means comprises a substantially frustum-shaped portion extending away from the base, the top of the frustum having a substantially coaxial aperture for receiving and engaging the securing means.

4. The button assembly of claim 3, wherein the hole is substantially transverse to the axis of the frustum.

5. The button assembly of claim 1, wherein the retaining means comprises a plurality of flexible retaining lugs.

6. The button assembly of claim 5, wherein the securing means is a roughened portion of the stem and the retaining lugs frictionally engage the roughened portion.

7. The button assembly of claim 5, wherein the securing means comprises a substantially conical portion having a generally spherical pointed tip used to penetrate the fabric.

8. The button assembly of claim 7, wherein the conical portion has a base end with a diameter larger than the separation between the flexible retaining lugs.

9. The button assembly of claim 1, wherein the base further comprises a means for releasably securing a decorative cap.

10. A button for use in a reusable button assembly which includes a removable stud having a stem terminating in securing means adapted to pierce a fabric and for releasable engagement with the button, the button comprising:

(a) a base having retaining means for receiving and for releasably engaging the securing means of the stud, the base also having a hole which is proximate, and transverse to, the retaining means and which permits a tool to have access to the securing means for facilitating the disengagement of the securing means from the retaining means; and (b) conically-shaped space means in the base for receiving unrestrictedly the securing means of the stem.

11. The button of claim 10, wherein the retaining means comprises a substantially frustum-shaped portion extending away from the base, the top of the frustum having a substantially coaxial aperture for receiving and engaging the securing means.

12. The button of claim 11, wherein the hole is substantially transverse to the axis of the frustum.

13. The button of claim 10, wherein the retaining means comprises a plurality of flexible retaining lugs.

14. The button of claim 10, wherein the base further comprises means for releasably securing a decorative cap.

15. The button of claim 10, wherein the space means comprises a substantially conically-shaped notch in the base.

16. The button of claim 10, wherein the space means comprises a cut-out which is shaped substantially identically to the fabric-piercing portion of the securing means.

* * * * *